US005810567A

United States Patent [19]

Horn

[11] Patent Number: 5,810,567

[45] Date of Patent: Sep. 22, 1998

[54] HYDRAULIC DIAPHRAGM PUMP

[75] Inventor: Waldemar Horn, Wimsheim, Germany

[73] Assignee: LEWA Herbert Ott GmbH & Co., Leonberg, Germany

[21] Appl. No.: 879,024

[22] Filed: Jun. 19, 1997

Related U.S. Application Data

[63] Continuation of Ser. No. 291,922, Aug. 18, 1994, abandoned.

[30] Foreign Application Priority Data

Aug. 19, 1993 [DE] Germany ..... 43 27 969.4

[51] Int. Cl.[6] ..... F04B 9/08

[52] U.S. Cl. ..... 417/387; 417/388; 92/100

[58] Field of Search ..... 417/383, 385, 417/386, 387, 388; 92/97, 99, 100

[56] References Cited

U.S. PATENT DOCUMENTS

| | | | |
|---|---|---|---|
| 1,101,266 | 6/1914 | Franklin | 417/388 |
| 2,919,650 | 1/1960 | Wiggermann | 417/386 |
| 3,075,468 | 1/1963 | Eifel | 417/388 |
| 3,277,829 | 10/1966 | Burgert | 417/387 |
| 4,741,252 | 5/1988 | Harter et al. | 92/98 |
| 4,828,464 | 5/1989 | Maier et al. | 417/388 |
| 4,865,528 | 9/1989 | Fritsch et al. | 417/388 |
| 4,883,412 | 11/1989 | Malizard et al. | 417/387 |
| 5,246,351 | 9/1993 | Horn et al. | 417/387 |

FOREIGN PATENT DOCUMENTS

| | | |
|---|---|---|
| 2 492 473 | 10/1980 | France . |
| 2 492 473 | 4/1982 | France . |
| 23 33 876 | 1/1975 | Germany . |
| 23 33 876 | 2/1977 | Germany . |
| 28 43 054 | 2/1983 | Germany . |
| 28 43 054 | 11/1987 | Germany . |
| 40 18 464 | 12/1991 | Germany . |
| 41 41 670 | 9/1994 | Germany . |

*Primary Examiner*—Charles G. Freay
*Attorney, Agent, or Firm*—Jacobson, Price, Holman & Stern, PLLC

[57] ABSTRACT

On a hydraulic diaphragm pump with a diaphragm including at least two individual layers, a dimensionally stable reinforcing element that moves together with the diaphragm and is kept in contact with the diaphragm is provided in the central area of the diaphragm. The inlet and outlet channels of the diaphragm pump open into the delivery chamber radially within the reinforcing element at least for the most part so the channels are covered accordingly by the reinforcing element.

11 Claims, 3 Drawing Sheets

HYDRAULIC DIAPHRAGM PUMP

This application is a file wrapper continuation of application Ser. No. 08/291,922, filed Aug. 18, 1994, now abandoned.

FIELD OF THE INVENTION

This invention concerns a hydraulically driven diaphragm pump.

BACKGROUND OF THE INVENTION

In order to maintain satisfactory operation of hydraulic diaphragm pumps, it is extremely important for the required amount of hydraulic fluid to be present at all times in the hydraulic chamber, for proper movement of the diaphragm to be assured and for stresses that could result in damage to the diaphragm to be prevented.

To compensate for a lack of sufficient hydraulic fluid in the hydraulic chamber, it is known from German patent 2,333,876 that a leakage compensation device can be provided that is controlled by the position of the diaphragm. This means that the diaphragm itself is responsible for actuating a control valve, whereby a relay valve that is connected to the diaphragm and is guided so it can slide in the pump body opens a connection from a supply chamber for the hydraulic fluid to the hydraulic chamber when the diaphragm reaches the end position of the intake stroke. The leakage can and should be compensated at the point when the diaphragm has reached a certain predetermined end position at the end of the intake stroke.

Other embodiments of such leakage compensating devices of diaphragm pumps are described in German patent 2,843,054 and in French patent 2,492,473.

In comparison with pressure-regulated compensation of leakage with a blow valve, controlling the leakage compensation on the basis of the position of the diaphragm offers a number of advantages. First, a great suction height or head can be overcome, where the head is limited only by the vapor pressure of the pneumatic fluid and hydraulic fluid. Secondly, overloading of the hydraulic chamber such as that which can occur in pressure-regulated compensation of leakage on the basis of vacuum peaks is prevented. Such marked vacuum peaks preferably occur with large-scale high-pressure diaphragm pumps at the start of the intake phase, when the liquid column in the intake line is suddenly accelerated on opening the intake valve. Finally, regulating the leakage compensation on the basis of the position of the diaphragm permits intake of hydraulic fluid at a low differential pressure of less than 0.3 bar, for example—in other words, the absolute pressure remains approx. 0.7 bar. This makes it possible to largely avoid any build-up of gas in the hydraulic chamber, which in turn offers certain advantages with regard to the pump delivery or flow rate and the accuracy in regulating it. Pressure-regulated leakage compensation, however, requires a relatively high setting of the differential pressure on the blow valve of 0.6 bar, for example, in order to assure reliable operation. The resulting drop in pressure in the hydraulic chamber to 0.4 bar abs. during the blow process leads to a greater release of gas. This in turn results in a reduced flow rate and less accuracy in adjusting it.

In practice, however, it has been found that these known diaphragm pumps still have certain weaknesses that should be eliminated. Thus, for example, before starting operation of the pump, care should be taken to assure that the diaphragm is never deflected too far in the direction of the pressure chamber with regard to the plunger. In addition, only a certain predetermined volume should be present in the hydraulic chamber because too much hydraulic fluid with the first pressure stroke of the plunger would result in overstressing the diaphragm or even rupturing it. However, an uncorrected volume of hydraulic fluid in the hydraulic chamber must always be expected when a reduced pressure is applied to the intake valve or the pressure valve of the pressure chamber during a pause in operation. The reduced pressure prevailing on the intake valve can be propagated to the pressure chamber and the hydraulic chamber by way of the intake valve which is never completely tight and this results in intake of hydraulic fluid from the supply chamber to the hydraulic chamber by way of the plunger seal.

In order to avoid having to manually reposition the diaphragm each time again before starting up the diaphragm pump in order to prevent damage to the diaphragm, it is already known from German patent (OLS) 4,141,670 that a diaphragm stroke limit can be provided in the end positions of the diaphragm in both the intake stroke and the pressure stroke. This is accomplished by a purely mechanical device in limiting the end position in the intake stroke, namely by means of a supporting disk with which the diaphragm is in contact in the end position of the intake stroke. However, the diaphragm stroke is limited by purely hydraulic means in the end position of the pressure stroke due to the fact that a valve element on the plunger end of a relay valve of a leakage compensating device is provided to interrupt the hydraulic connection from the plunger working space to the diaphragm working space, and excess hydraulic fluid is displaced into the supply chamber by means of a pressure limiting valve.

However, one problem with this design is that the hydraulic method of limiting the diaphragm stroke is relatively expensive and no display devices are provided to signal damage to or rupturing of the diaphragm.

In order to permit monitoring of the condition of the diaphragm, it is already known that the diaphragm of a diaphragm pump of the generic type (German patent (OLS) 4,018,464) can be designed as a sandwich membrane or diaphragm, where the membrane consists of two individual layers held with a space between them. The interspace between the individual layers is connected to a display device which responds as soon as the fluid pressure is propagated into the diaphragm interspace—from either the delivery chamber or the pressure chamber—when one of the individual layers ruptures. In order to avoid a mutual lifting of the individual layers which occurs especially in the intake stroke with this known diaphragm pump design, they are attached at a number of locations, especially by welding. However, the intake and outlet channels of this known diaphragm pump cannot be designed with the large dimensions that would often be desirable for media with a high viscosity. This is apparent from the fact that, as already mentioned, the diaphragm is forced with a high pressure against the wall of the pump cap that limits the pressure chamber in start-up of the pump. Large inlet and outlet channels would then under some circumstances result in the medium "shooting through" the diaphragm at these locations. For this reason, it is also necessary with the known diaphragm pump for the inlet and outlet channels to be located in the immediate proximity of the clamped edge of the diaphragm, although this results in a greater pressure drop inside the pump and a loss of efficiency.

SUMMARY OF THE INVENTION

On the basis of this state of the art, the present invention is based on the problem of creating a diaphragm pump of the type described initially that will have a high functional reliability and an improved efficiency and can be used universally.

With the diaphragm pump according to this invention, a dimensionally stable reinforcing element that is kept in contact with the diaphragm and moves together with the membrane is provided in the middle area of the diaphragm. In addition, the inlet and outlet channels open radially inside the reinforcing element at least for the most part, so they are covered by the reinforcing element accordingly.

The functional reliability of a hydraulically driven diaphragm pump is greatly increased by the dimensionally stable reinforcing element provided in the central area of the diaphragm according to this invention. This is apparent especially from the fact that the reinforcing element also supports the diaphragm over a large area in the vicinity of the inlet and outlet channels even if the diaphragm is forced into its pressure stroke end position in starting up the pump, for example. This makes it possible to reliably prevent a hole from being blown in the diaphragm. It is especially advantageous here that the inlet and outlet channels can readily be located relatively close to the central axis of the delivery chamber, in other words, in the area where the stroke of the diaphragm is the greatest. In addition, the dimensions of the inlet and outlet channels can be very large with this design. The pressure drop inside the pump can be greatly reduced due to the large inlet and outlet channels located close together, and the scope of application of the pump is increased because now it is also possible to pump even media with a high viscosity with no problem.

In the same way as when the reinforcing element according to this invention is provided on the delivery chamber side, the reinforcing element may also be placed on the hydraulic chamber side, in which case it still contributes toward protecting the diaphragm even if the reinforcing element is designed with such large dimensions and positioned in such a way that it also covers the inlet and outlet channels for the hydraulic fluid. In this case the reinforcing element acts as a supporting element that reinforces or strengthens the diaphragm even in the end position of the intake stroke.

Another protective effect on the diaphragm is achieved due to the fact that the diaphragm is not subjected to any bending stresses in the area of the reinforcing element. An appropriate design of the reinforcing element also assures that the diaphragm will be subjected to dynamically balanced stresses, which also makes a significant contribution toward protecting the diaphragm.

According to an advantageous embodiment of this invention, a contact face in the pump cap that works together with the reinforcing element in the pressure stroke end position is provided on the delivery chamber side and a pump body contact face that works together with the reinforcing element directly or by way of an intermediate element is provided on the hydraulic chamber side in order to mechanically limit the stroke of the diaphragm on both sides. Hydraulic stroke limiting devices in order to limit the pressure stroke, for example, are thus no longer necessary.

The reinforcing element is preferably in contact with the outside surface of the diaphragm. With such an arrangement, the reinforcing element provides additional protection for the diaphragm from a chemical standpoint since it provides protection against aggressive media and also from a mechanical standpoint because it reduces the mechanical stress on the diaphragm in the main area of stress due to the medium pumped. Such a reinforcing element is also a protective element when the diaphragm is in contact with the stop face of the pump cap in the end position of its pressure stroke.

The reinforcing element preferably consists of a coupling element on the delivery chamber side and another coupling element on the hydraulic chamber side with the individual layers of the diaphragm clamped between them and thus mechanically connected to each other. In this way, the reinforcing element according to this invention reliably prevents the layers of the diaphragm from lifting up during the intake stroke. Any resulting impairment in the suction efficiency and pump efficiency can thus be prevented reliably. In addition, this also prevents changes in pressure between the layers of the diaphragm due to the mutual lifting of the diaphragm layers which would result in a response in the diaphragm rupture display device connected to the diaphragm, although there is no leakage of the diaphragm in this case.

Preferably the coupling elements are designed such that together with the respective pump body face and pump cap face they form in the end positions of the pressure stroke and the intake stroke a supporting surface for the diaphragm that is at least essentially continuous and is adapted to the natural geometry of the diaphragm. Such a design contributes greatly toward protection of the diaphragm.

It is especially advantageous if the coupling elements are designed as dynamically balanced supporting disks with especially flat faces. The flat face toward the diaphragm acts as a large-area stop in the end positions of the pressure stroke and the intake stroke, while the flat face toward the diaphragm is designed as a large-area supporting face for the diaphragm.

According to an advantageous embodiment of this invention, the reinforcing element is enclosed at least partially by a plastic layer that protects the reinforcing element from corrosive media but can also be designed in such a way that it functions as a damping element when the reinforcing element is in contact with the pump cap in the pressure stroke end position, for example.

According to an advantageous embodiment, the coupling element on the delivery chamber side has a rod-like mounting part that passes through central through-holes in the diaphragm and the coupling element on the hydraulic chamber side and is attached to a relay valve of a leakage compensation device that is regulated on the basis of the position of the diaphragm. In this process, the relay valve preferably also has a continuous longitudinal hole through which the rod-like mounting device passes, so it can be attached to the end of the relay valve facing the displacement piston.

A simple design is obtained when the coupling element on the hydraulic chamber side is designed so it is an integral part of the relay valve, in other words, they are designed in one piece.

According to a modified embodiment of this invention, the reinforcing element is arranged between the individual layers of the diaphragm and is attached securely to it, especially by bonding or welding. In such an embodiment, the reinforcing element also preferably consists of a flat, dynamically balanced disk that permits a simple design of the reinforcing element and the respective stop faces in the pump cap and the pump body.

According to an expedient embodiment, the reinforcing element can move between the end positions of its intake stroke and its pressure stroke in a manner that is at least partially independent of a central supporting disk on the hydraulic chamber end.

Preferably the radius of the reinforcing element is equal to or greater than half the radius of the section of the diaphragm in the delivery chamber. In other words, a radius of a stiffener is equal to or greater than one-half a radius of a portion of the membrane disposed in the pumping space. This yields large stop faces or supporting faces that reduce the mechanical pressure load on the reinforcing element, the pump body and the pump cap as well as the diaphragm and at the same time assure that the individual layers of the diaphragm are held securely together.

It is advantageous for the inlet and outlet channels to open into the delivery chamber in such a way that the distance between their center points and the central axis of the delivery chamber amounts to at most 50% of the largest radius of the delivery chamber. In other words, the inlet channel and the outlet channel open into the pumping space in such a way that a distance from a midpoint of a port opening locus of each said channel to a center axis of the pumping space is at most 50% of a maximum radius of the pumping space.

The pressure drop inside the pump can preferably be reduced by having the inlet and outlet channels be aligned so they are parallel to the direction of movement of the diaphragm in the area of their openings on the side of the delivery chamber.

Since the reinforcing element is designed so it has dimensional stability, it is advantageous if the individual layers of the diaphragm have a crimp in the area between the reinforcing element and the clamping at the edge. First, this crimp permits the desired mobility of the diaphragm and secondly, the crimp is preferably designed with enough stiffness to prevent any mutual lifting of the individual layers of the diaphragm in the intake stroke.

Preferably a vent hole that opens into the delivery chamber at the highest geodetic point of the delivery chamber and is connected to the outlet channel is provided in the pump cap. This vent hole, which may be designed with a relatively small bore in relation to the inlet and outlet channels is provided in order to vent the delivery chamber.

In addition, it is advantageous for an outlet hole for solid particles to be provided in the pump cap. This outlet hole opens into the delivery chamber at the lowest geodetic point of the delivery chamber and communicates with the inlet channel. This hole serves to remove sedimented particles so as to prevent these particles from becoming trapped between the pump cap and the diaphragm, which would lead to damage to the diaphragm.

The hydraulic chamber is preferably connected to a pressure limiting valve, because as mentioned initially, the diaphragm or the reinforcing element may come in contact with the pump cap when starting up the pump. If the plunger then continues to move in the direction of its end position in the pressure stroke or if a certain preset maximum pressure is exceeded, excess hydraulic oil is released into the supply reservoir through the pressure limiting valve. Then the diaphragm again functions in its normal operating range.

BRIEF DESCRIPTION OF THE DRAWINGS

This invention is explained in greater detail below on the basis of the embodiments illustrated in the figures, which show the following.

DETAILED DESCRIPTION OF THE PREFERRED EMBODIMENTS

Figure 1:
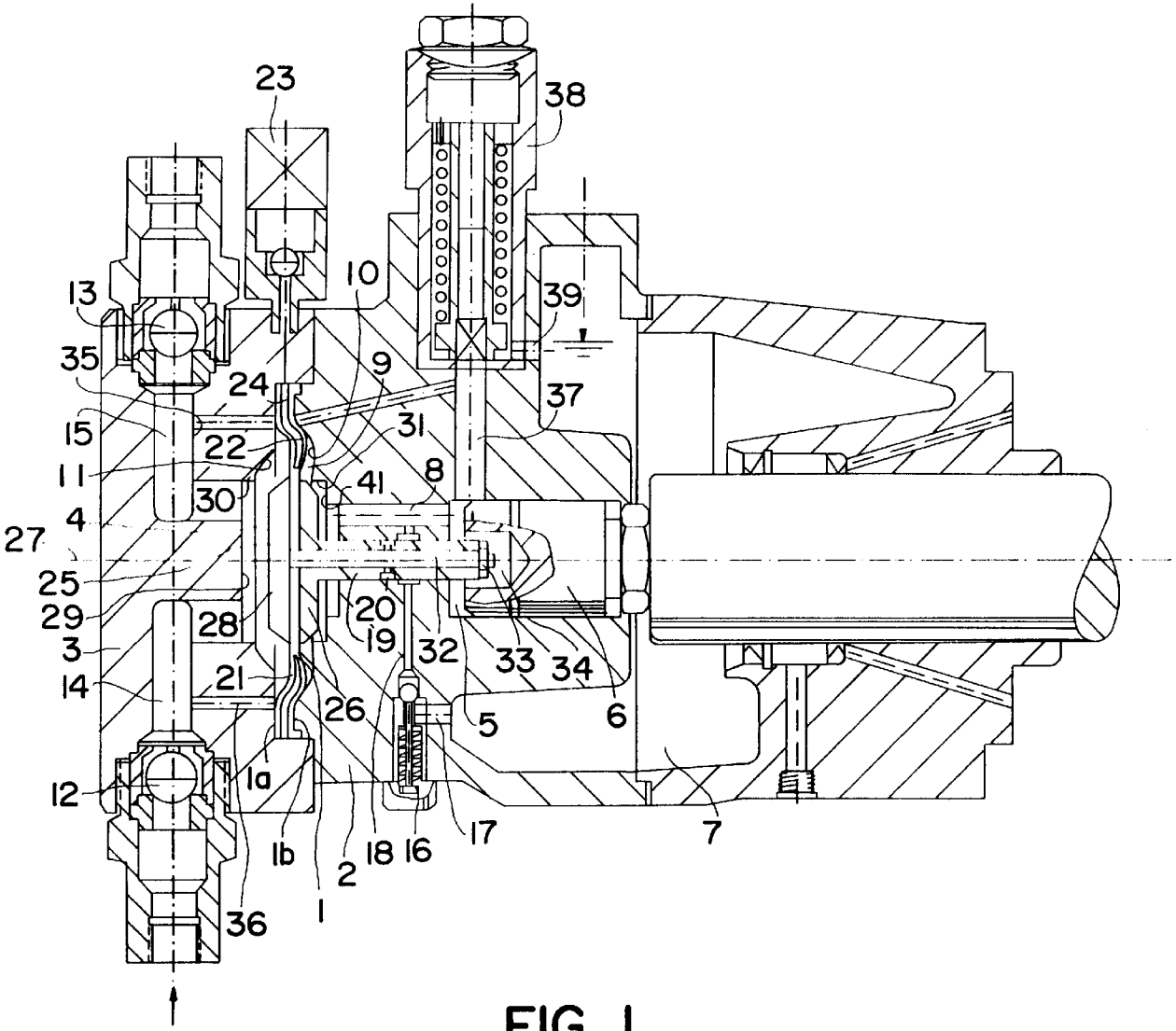
FIG. 1 shows a schematic cross section through a diaphragm pump according to this invention.

FIG. 1 shows a hydraulic diaphragm pump having a diaphragm 1 that consists of two separate individual layers 1*a*, 1*b*, especially made of a plastic. The diaphragm is clamped at its edges between a pump body 2 and a pump cap 3 that is detachably mounted on the end of the pump body and separates a delivery chamber 4 from a hydraulic chamber 5 that is filled with a hydraulic fluid and forms the working chamber of the plunger.

The diaphragm pump has a hydraulic diaphragm drive in the form of an oscillating displacement piston 6 that can be displaced in the pump body 2 in such a way that a seal is formed between the working chamber 5 of the plunger and an antechamber 7 for the hydraulic fluid. The working chamber 5 of the plunger communicates with a pressure chamber 9 on the diaphragm side by means of at least one axial hole 8 provided in pump body 2. This pressure chamber 9 is the working chamber of the diaphragm and together with the working chamber 5 of the plunger it forms the hydraulic chamber as a whole. As this shows, the working chamber 9 of the diaphragm is limited by the diaphragm 1 on one side and by a rear cup 10 (on the side of the plunger). This rear cup stop 10 is formed by the suitably shaped end face of pump body 2 and is part of the mechanical supporting face with which the diaphragm 1 is in contact at the end of the intake stroke.

In addition to the cup stop 10 on the plunger side, a front cup stop 11 is formed by the end face of pump cap 3 in the delivery chamber 4. Pump cap 3 is provided with an inlet valve 12 (intake valve) and an outlet valve 13 (delivery valve or pressure valve) in the usual way. These two valves 12, 13 communicate with the delivery chamber 4 through the inlet channel 14 and the outlet channel 15 in such a way that the delivery medium and thus the diaphragm 1 as well are sucked into the delivery chamber 4 through the intake valve 12 and the inlet channel 14 in the intake stroke of the displacement piston 6 that takes place in the direction to the right according to FIG. 1. However, with the pressure stroke of the diaphragm 1 that takes place toward the left according to FIG. 1, the delivery medium can be discharged from the delivery chamber 4 through the outlet channel 15 and the pressure valve 13.

A leakage compensating device is provided in order to prevent cavitation from occurring at the end of the diaphragm intake stroke and to assure the required compensation of leakage that is necessary because of the leakage losses. This leakage compensating device has a conventional spring-loaded blow valve 16 that communicates with the supply reservoir 7 through channel 17 and with both the plunger working chamber 5 and the diaphragm working chamber 9 through channel 18 and connecting channel 8.

The leakage compensation is controlled by a control valve that has a relay valve 19 that is guided coaxially with the displacement piston 6 so it can move in a corresponding bore in pump body 2 in the area of the connecting channel 8 between the working chamber 9 of the diaphragm and the working chamber 5 of the plunger. A peripheral groove 20 that establishes the connection between the blow valve 16 of the leakage compensating device and the hydraulic chamber 5, 9 through channels 18 and 8 in the end position of the intake stroke of the diaphragm 1 is provided at a certain location on the periphery of the relay valve 19.

The individual layers 1*a*, 1*b* of the diaphragm 1 are designed so that they are dynamically balanced and have a crimp 21 in the area near the edge to permit free mobility of the layers 1*a*, 1*b* between the end positions of their intake stroke and pressure stroke. In the area of these crimps 21 the individual layers 1*a*, 1*b* run with a distance between them, thus forming a diaphragm interspace 22. In the event one of the diaphragm layers 1*a*, 1*b* is ruptured, this diaphragm interspace 22 serves to rapidly signal the diaphragm rupture by means of an appropriate display device 23 that is connected to the diaphragm interspace 22. Diaphragm interspace 22 is formed by the fact that the diaphragm layers 1*a*, 1*b* are secured with a distance between them by means of a ring 24 in the clamping zone at the edge. This ring 24 is provided with one or more channels (not shown) that establish the connection between the diaphragm interspace 22 and the interior of the diaphragm rupture display device 23.

In contrast with their edge areas, the individual layers 1*a*, 1*b* of diaphragm 1 do not have a distance between them in the middle area but instead they are held tightly against each other by means of coupling elements in the form of supporting disks 25, 26 arranged on both sides. The supporting disks 25, 26 are designed so they are essentially mirror images of each other and they are arranged centrally with regard to the middle axis 27 of the relay valve 19. The supporting disks 25, 26 together form a dimensionally stable reinforcing element for diaphragm 1.

The supporting disk 25 on the side of the delivery chamber has a flat face 28 that faces the pump cap 3 and is parallel to another flat face 29 of pump cap 3. This face 29 of pump cap 3 is located between the mouths of the inlet channel 14 and the outlet channel 15 in the delivery chamber and serves as a stop face for the supporting disk 25 in the end position of the pressure stroke of diaphragm 1.

The diameter of the supporting disk 25 on the delivery chamber side—in other words, its extent in the radial direction—is such that the supporting disk 25 completely covers the mouths of the inlet channel 14 and the outlet channel 15 in the radial direction so that these mouths are sealed by the supporting disk 25 in the end position of the pressure stroke of diaphragm 1. In this end position of the pressure stroke, the supporting disk 25 is in an axial borehole 30 of the pump cap 3, so the flat supporting face of the supporting disk 25 together with the outside radial area of cup 11 of the pump cap 3 forms a supporting face that is adapted to the natural geometry of the diaphragm and is almost completely free of gaps. Even at high pressures, the diaphragm 1 therefore cannot be forced into the inlet channel 14 or the outlet channel 15 and thus damaged.

The supporting disk 26 on the side of the hydraulic chamber is designed to be essentially a mirror image of supporting disk 25. In the end position of the intake stroke of diaphragm 1, the supporting disk 26 is forced into an axial borehole 31 of the pump body 2, while the face of supporting disk 26 that faces the displacement piston 6 comes to rest against a face 41 of pump body 2. The flat supporting face of the supporting disk 26 that is in contact with diaphragm layer 1*b* together with the outside radial area of the bordering face of cup 10 that forms the working chamber of the diaphragm also forms a supporting face for diaphragm layer 1*b* that is adapted to the natural geometry of the diaphragm and is virtually free of gaps. Supporting disk 26 is designed as an integral part with relay valve 19—in other words, it is molded or die cast in one piece with it.

The supporting disk 25 on the delivery chamber side is mounted on the supporting disk 26 or on the relay valve 19 on the hydraulic chamber side by means of a rod-like mounting part 32 that extends through central through-holes within the diaphragm layers 1*a*, 1*b* of the supporting disk 26 on the hydraulic chamber side and the relay valve 19 and is attached to the end of the relay valve 19 facing the displacement piston 6 by means of a nut 33.

In order not to limit the space available for movement of the displacement piston 6, an axial borehole 34 whose diameter is larger than that of the relay valve 19 is provided in the displacement piston 6. In this way, the displacement piston 6 can be moved beyond the projecting end of the relay valve 19 in the direction of diaphragm 1.

The inlet channel 14 and the outlet channel 15 are aligned in such a way that they run parallel to the central axis 27 of the relay valve 19 and thus parallel to the direction of movement of diaphragm 1 in the area of the mouths of the channels. Since these channels are also arranged relatively close to the central axis 27, they are located in the area of the largest stroke movement of the diaphragm 1, so this yields a forced flow through delivery chamber 4.

At least one small borehole 35 that is designed to be pressure-proof is provided at the highest geodetic point of the delivery chamber 4 and opens into outlet channel 15. This borehole serves to vent the delivery chamber 4.

In addition, at least one small borehole 36 that is designed to be pressure-proof and opens into the inlet channel 14 is provided at the lowest geodetic point of the delivery chamber 4. This borehole 36 serves to remove sedimented particles in order to prevent the particles from becoming lodged between the pump cap 3 and the diaphragm 1, where they could result in damage to the diaphragm 1.

In normal operation, the diaphragm 1 operates at a definite distance from the cup stop 11 in the pump cap 3 so the diaphragm 1 is not put under stress by mechanical contact. When starting the pump, however, the diaphragm 1 may be moved beyond the end position of the pressure stroke to the point where the supporting disk 25 comes to rest against the end face 29 of the pump cap 3 and the diaphragm 1 is in contact with the supporting face in the pump cap 3. If the displacement piston 6 then moves further in the direction of the end position of its pressure stroke or if a certain predetermined maximum pressure is exceeded, excess hydraulic fluid is removed into the supply reservoir 7 through a channel 37 and a pressure limiting valve 38 connected to it and through a channel 39. If the diaphragm 1 first moves beyond the end position of its intake stroke in starting up the pump to a position where the supporting disk 26 is in contact with the end face 41 of the pump body 2 and the diaphragm 1 is in contact with the supporting face in the pump body 2, hydraulic fluid is drawn in from the supply reservoir 7 through the blow valve 16 and the relay valve 19. However, a purely mechanical support of the diaphragm 1 by means of supporting disks 25, 26 is achieved in both end positions, while at the same time assuring a reliable mutual connection of the diaphragm layers 1*a*, 1*b*.

Figure 2:
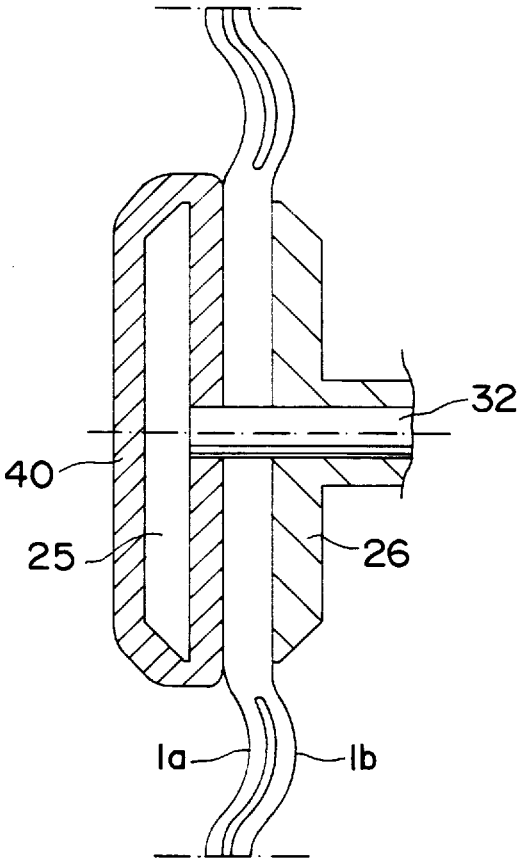
FIG. 2 shows an enlarged diagram of a reinforcing element in the form of two coupling elements between which the diaphragm is clamped, where the coupling element on the delivery chamber side is sheathed in plastic.

In the embodiment illustrated in FIG. 2, the supporting disk 25 on the delivery chamber side is completely surrounded by a layer of plastic that has a shock absorbing effect when the supporting disk 25 comes to rest against end face 29 of pump cap 3 and can be designed to protect the supporting disk 25 from corrosive media. Again with this embodiment, the diaphragm layers 1*a*, 1*b* are reinforced in the central area by means of the supporting disks 25, 26 so that damage to diaphragm 1 can be safely prevented in this area.

Figure 3:
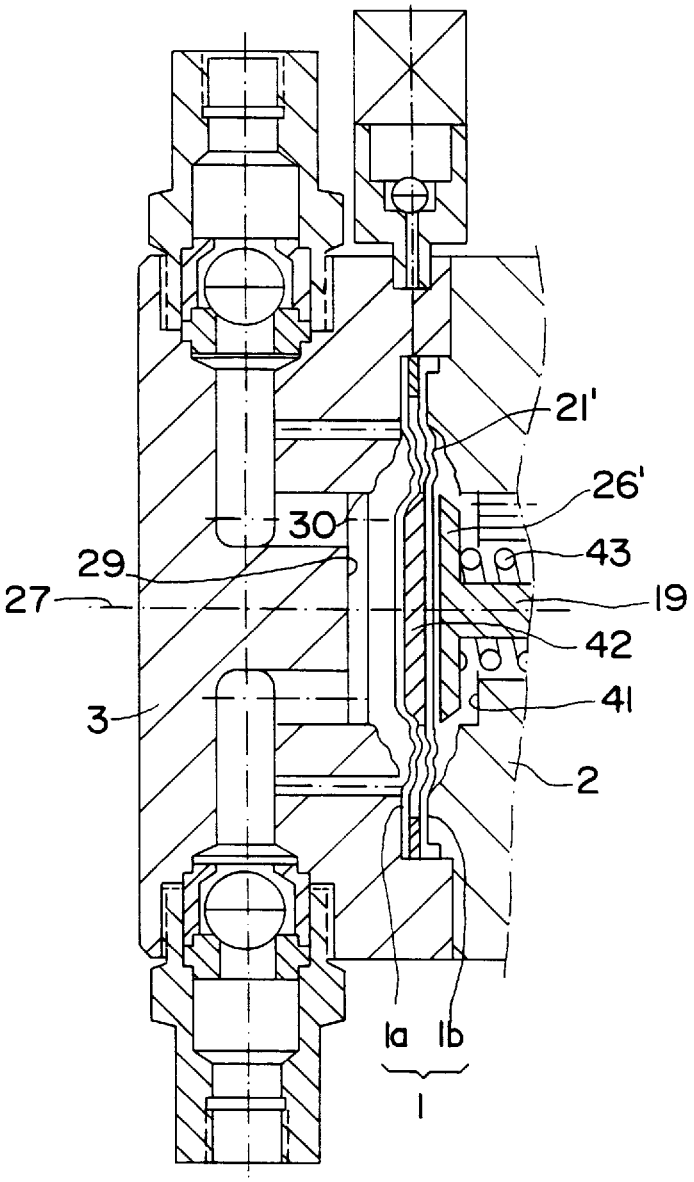
FIG. 3 shows a partial diagram of a modified embodiment of the diaphragm pump according to this invention.

In a modified embodiment according to FIG. 3, a disk-shaped, dynamically balanced reinforcing element 42 is provided between the diaphragm layers 1*a*, 1*b* in such a position that it is central to the central axis 27. The diaphragm layers 1*a*, 1*b* are welded or bonded to the reinforcing element 42 in such a way that they do not become loosened from the reinforcing element 42 even when a great vacuum prevails in the intake stroke and they retain their relative mutual positions with a space between them.

The diameter of the reinforcing element 42 is such that it is only slightly smaller than the diameter of the borehole 30 in the pump cap 3, so the central area of diaphragm layer 1*a* on the delivery chamber side together with at least part of the reinforcing element 42 can penetrate into borehole 30 until the diaphragm layer 1*a* is in contact with the end face 29 of the pump cap 3. In this contacting position, in other words, in the end position of the pressure stroke of the diaphragm 1—the inlet channel 14 and the outlet channel 15 are again covered almost completely by the reinforcing element 42, so this reliably prevents the diaphragm 1 from being forced into the inlet channel 14 or the outlet channel 15.

On the hydraulic chamber side, a supporting disk 26' that is designed as a mirror image and is manufactured in one piece with the relay valve 19 is arranged so it is flush with the reinforcing element 42. In the embodiment illustrated in FIG. 3, relay valve 19 is under the influence of compression spring 43. This compression spring 43 is supported on pump body 2 on the one hand and on supporting disk 26' on the other hand, so the relay valve 19 is put under preliminary tension in the direction of diaphragm 1 and follows the movement of diaphragm 1 from the end position of the intake stroke in the direction of the pressure stroke. However, this sequential movement takes place only over a range that amounts to 30–40% of the initial diaphragm pressure stroke, for example, because the relay valve 19 comes in contact with a stop (not shown)—for example, in the form of a Seeger circlip ring on the end on the side of the plunger. This stop limits the displacement movement of the relay valve 19 in the direction of the diaphragm pressure stroke. Diaphragm 1 thus moves independently in the direction of the end position of its pressure stroke over a significant portion of its stroke and thus is released from the supporting disk 26' on the side of the hydraulic chamber.

In order to assure free mobility between the end positions of the pressure stroke and the intake stroke, the diaphragm layers 1*a*, 1*b* have a double crimp 21'—in other words, a wavy bead or crimp—in the area between the reinforcing element 42 and the clamping zone at the edges. In the end positions of the pressure stroke and the intake stroke, crimps 21' are in contact with the bordering walls of the pump body 2 and the pump cap 3 that have the same wavy contour as crimps 21' in order to protect the diaphragm.

I claim:

1. A hydraulically driven membrane pump for a pumpable medium, said pump comprising:

a membrane having edges held by a ring between a pump housing and a pump cover, said membrane including at least two individual layers separating a pumping space from a hydraulic compression space, said pumping space, where pumping is performed on the pumpable medium, having an inlet channel and an outlet channel separate from said inlet channel, said membrane being reciprocally movable between a suction stroke position and a compression stroke position by a hydraulic membrane drive in the form of a reciprocating pumping piston, and a stiffener being provided in a central region of the membrane, said stiffener being held forcibly against the membrane and moving along with said membrane, and at least parts of the inlet channel and outlet channel being disposed radially interiorly of said stiffener at a port opening locus of said channels opening out into the pumping space, a front stop surface of the pump cover cooperating with the stiffener to mechanically limit the compression stroke at a position therefor, and a rear stop surface of the pump body cooperating with the stiffener to mechanically limit the suction stroke at a position therefor, whereby the stroke of the membrane is limited in both directions, abutting surfaces being provided to support the membrane on the pump cover side and the pump body side, respectively, the abutting surfaces, together with the stiffener, form, in the compression stroke limiting position and the suction stroke limiting position, respectively, of the membrane, an at least substantially continuous membrane support surface adapted to a natural geometry of the membrane, and a bore being provided at one of a geodetically highest and a lowest point of the pump cover, the bore connecting the pumping space with one of the outlet channel and the inlet channel, respectively.

2. A membrane pump according to claim 1, wherein the stiffener is pressed against an outer surface of the membrane.

3. A membrane pump according to claim 1, wherein the stiffener is comprised of a pair of coupling members including a pumping-space-side coupling member and a hydraulic-compression-space-side coupling member between which the individual layers of the membrane are held by said ring and are thereby mechanically bound together.

4. A membrane pump according to claim 3, wherein the coupling members are rotationally symmetric supporting discs having planar abutting faces in a transverse direction pressed against the membrane.

5. A membrane pump according to claim 3, wherein the pumping-space-side coupling member has a rod-like fastening member extending through a central throughgoing bore in the membrane and also through the hydraulic-compression-space-side coupling member, and said fastening member is fastened to a sliding control member of a leak-compensating device.

6. A membrane pump according to claim 5, wherein the rod-like fastening member of the pumping-space-side coupling member extends through a throughgoing longitudinal bore in the sliding control member, and said fastening member is fastened to the end of said control member directed toward the pumping piston.

7. A membrane pump according to claim 5, wherein the hydraulic-compression-space-side coupling member is of a unitary construction with the sliding control member.

8. A membrane pump according to claim 1, wherein a radius of the stiffener is equal to or greater than one-half a radius of a portion of the membrane disposed in the pumping space.

9. A membrane pump according to claim 1, wherein the inlet channel and the outlet channel open into the pumping space in such a way that a distance from a midpoint of a port opening locus of each said channel to a center axis of the pumping space is at most 50% of a maximum radius of the pumping space.

10. A membrane pump according to claim 9, wherein a longitudinal axis of the inlet channel and a longitudinal axis of the outlet channel, in regions of said channels near their respective port opening loci into the pumping space, are both parallel to a direction of movement of the membrane.

11. A membrane pumping according to claim 1, wherein each membrane layer has a bend or corrugation in a region between the stiffener and the clamp at the edge of the membrane, by which clamp the membrane is held between the pump housing and the pump cover.

* * * * *